US010898045B2

(12) United States Patent
Woo et al.

(10) Patent No.: US 10,898,045 B2
(45) Date of Patent: Jan. 26, 2021

(54) DUST COLLECTING APPARATUS FOR VACUUM CLEANER AND VACUUM CLEANER INCLUDING SAME

(71) Applicant: LG ELECTRONICS INC., Seoul (KR)

(72) Inventors: Seyoung Woo, Seoul (KR); Joonho Pyo, Seoul (KR); Soohan Eo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 436 days.

(21) Appl. No.: 15/572,753

(22) PCT Filed: May 9, 2016

(86) PCT No.: PCT/KR2016/004795
§ 371 (c)(1),
(2) Date: Nov. 8, 2017

(87) PCT Pub. No.: WO2016/190565
PCT Pub. Date: Dec. 1, 2016

(65) Prior Publication Data

US 2018/0125316 A1 May 10, 2018

(30) Foreign Application Priority Data

May 26, 2015 (KR) ..... 10-2015-0073156

(51) Int. Cl.
*A47L 9/10* (2006.01)
*A47L 9/16* (2006.01)

(52) U.S. Cl.
CPC ..... *A47L 9/1683* (2013.01); *A47L 9/108* (2013.01); *A47L 9/16* (2013.01); *A47L 9/1608* (2013.01); *A47L 9/1666* (2013.01)

(58) Field of Classification Search
CPC ..... A47L 9/1683; A47L 9/108; A47L 9/16; A47L 9/1608; A47L 9/1666
See application file for complete search history.

(56) References Cited

U.S. PATENT DOCUMENTS 6,192,550 B1 * 2/2001 Hamada ..... A47L 5/28 15/352
7,582,128 B2 9/2009 Hwang et al.
(Continued)

FOREIGN PATENT DOCUMENTS

EP 1 023 864 8/2000
EP 2 255 709 12/2010
(Continued)

OTHER PUBLICATIONS

European Search Report dated Feb. 28, 2019 issued in Application No. 16800205.3.
(Continued)

*Primary Examiner* — Joseph J Hail
*Assistant Examiner* — J Stephen Taylor
(74) *Attorney, Agent, or Firm* — Ked & Associates LLP

(57) ABSTRACT

The present invention provides a dust collecting apparatus for a vacuum cleaner, comprising: a first cyclone installed in a first case and configured to separate dust from air introduced thereinto together with foreign substances and to discharge the separated dust to a first dust storage unit; a second cyclone mounted above the first cyclone and configured to separate fine dust from the air from which the dust is separated by the first cyclone and to discharge the separated fine dust to a second dust storage unit; a compression device configured such that at least a part thereof performs normal rotation in one direction and reverse rotation in the direction opposite to that of the normal rotation along the outer peripheral surface of a second case having the second dust storage unit therein to compress the dust stored in the
(Continued)

first dust storage unit; a screw rotatably installed above the compression device and having a guide vane spirally extending along the outer periphery thereof to guide the collection of dust into the first dust storage unit; a driving unit that transmits a driving force to the compression device to selectively enable the normal rotation and the reverse rotation of the compression device; and a gear unit installed between the compression device and the screw to enable the screw to perform normal rotation while the compression device performs the normal rotation and the reverse rotation.

17 Claims, 10 Drawing Sheets

(56) References Cited

U.S. PATENT DOCUMENTS

| | | | | |
|---|---|---|---|---|
| 7,611,558 | B2 | 11/2009 | Oh et al. | |
| 8,726,459 | B2 * | 5/2014 | Yun | A47L 9/108 15/347 |
| 10,299,645 | B2 * | 5/2019 | Hyun | A47L 9/1641 |
| 2005/0172584 | A1 * | 8/2005 | Oh | A47L 9/1625 55/345 |
| 2008/0264015 | A1 * | 10/2008 | Oh | A47L 9/108 55/429 |
| 2009/0293221 | A1 * | 12/2009 | Hwang | A47L 9/108 15/347 |
| 2010/0263161 | A1 * | 10/2010 | Lee | A47L 5/362 15/347 |
| 2012/0102671 | A1 * | 5/2012 | Kwon | A47L 5/225 15/347 |
| 2014/0366311 | A1 * | 12/2014 | Han | A47L 9/16 15/339 |

FOREIGN PATENT DOCUMENTS

| | | |
|---|---|---|
| EP | 2 417 886 | 2/2012 |
| EP | 2 786 688 | 10/2014 |
| GB | 2512587 | 10/2014 |
| JP | 2004-176847 | 6/2004 |
| JP | 2007-222614 | 9/2007 |
| JP | 2010-004909 | 1/2010 |
| JP | 2014-023782 | 2/2014 |
| KR | 10-2007-0088022 | 8/2007 |
| KR | 10-0842963 | 7/2008 |
| KR | 10-2008-0097110 | 11/2008 |
| KR | 10-2014-0144890 | 12/2014 |

OTHER PUBLICATIONS

International Search Report (with English Translation) and Written Opinion dated Aug. 19, 2016 issued in Application No. PCT/KR2016/004795.

Japanese Notice of Allowance dated Dec. 11, 2018 issued in Application No. 2018-511573.

Australian Examination Report dated Jun. 7, 2018 issued in Application No. 2016267831.

* cited by examiner

DUST COLLECTING APPARATUS FOR VACUUM CLEANER AND VACUUM CLEANER INCLUDING SAME

CROSS-REFERENCE TO RELATED PATENT APPLICATIONS

This application is a U.S. National Stage Application under 35 U.S.C. § 371 of PCT Application No. PCT/KR2016/004795, filed May 9, 2016, which claims priority to Korean Patent Application No. 10-2015-0073156, filed May 26, 2015, whose entire disclosures are hereby incorporated by reference.

TECHNICAL FIELD

The present invention relates to a dust collecting apparatus for a vacuum cleaner and a vacuum cleaner having the same, the dust collecting apparatus capable of collecting dust by separating the dust from air introduced into a vacuum cleaner through a multi-cyclone method, and capable of easily discharging the collected dust.

BACKGROUND ART

A vacuum cleaner is an apparatus for sucking air by using a suction force generated from a suction motor, and for discharging clean air by separating dust or particles from the air.

The vacuum cleaner may be categorized into 1) a canister type, 2) an upright type, 3) a hand type, 4) a cylinder-shaped floor type, etc.

The canister type of vacuum cleaner, which is the most-commonly used at home nowadays, is a vacuum cleaner where a suction nozzle and a body are communicated with each other by a connection pipe. The canister type of vacuum cleaner is suitable for cleaning of a hard floor, because it performs a cleaning operation by using only a suction force as it includes a cleaner body, a hose, a pipe, a brush, etc.

On the other hand, the upright type of vacuum cleaner is a vacuum cleaner where a suction nozzle and a body are integrally formed with each other. The upright type of vacuum cleaner may remove dust, etc. inside a carpet, because it is provided with a rotation brush unlike the canister type vacuum cleaner.

In any type of vacuum cleaner which is currently used, dust (foreign materials, dirt, mote, etc.) collected in a dust collecting apparatus should be discharged from the dust collecting apparatus, after a cleaning operation. In the process of discharging dust from the dust collecting apparatus, it is not desirable to discharge the dust to an unintended region.

The conventional dust collecting apparatus for a vacuum cleaner has a multi-cyclone structure. The multi-cyclone structure includes a first cyclone configured to primarily collect dust by sucking contaminated air from outside, and a second cyclone connected to the first cyclone and configured to secondarily collect fine dust. In the multi-cyclone, the second cyclone is a set of a plurality of small cyclones.

The conventional dust collecting apparatus for a vacuum cleaner has the following problems.

Firstly, since dust has a relatively larger size at the first cyclone, it is blocked by an inlet of the dust storage unit. This may hinder collection of other dust, thereby lowering a dust collecting performance.

Accordingly, for collection of dust blocked by the inlet of the dust storage unit, it is required to review a structure to drop dust blocked by the inlet to a dust collecting unit by rotating the inlet.

Further, a compression plate for compressing a larger amount of dust is used at the dust collecting unit for collecting dust filtered at the first cyclone. And a driving motor was required to drive the compression plate.

In order to drop dust blocked by the inlet to the dust collecting unit, the inlet side should be rotated. In this case, if another power source is provided, power loss may be increased, and there may be a disadvantage in the aspect of a package of a design space.

In case of a cleaner having a device for removing dust blocked by a filter at an upper part thereof and having a device for compressing dust at a lower part thereof, one motor may be provided. However, in this case, the motor should be rotated in two directions in order to drive the devices, which requires an additional control. Accordingly, when the motor is clockwise rotated, only the lower device for compressing dust is operated. On the other hand, when the motor is counterclockwise rotated, only the upper device for brushing dust blocked by a filter is operated. Accordingly, there was a discontinuity between operations of the respective devices, and there was a difficulty in simultaneously performing the two operations.

In order to solve such problems, developed is a structure to use a driving motor for driving the compression plate without an additional power source when operating the compression plate and the dust brushing device, and to simultaneously perform the operations.

DISCLOSURE OF THE INVENTION

Technical Problem

Therefore, an object of the present invention is to provide a dust collecting apparatus for a vacuum cleaner and a vacuum cleaner having the same, the dust collecting apparatus capable of compressing dust and fine dust collected in a first dust storage unit, respectively, in order to easily discharge the dust and the fine dust therefrom.

Another object of the present invention is to provide a dust collecting apparatus for a vacuum cleaner and a vacuum cleaner having the same, the dust collecting apparatus capable of simultaneously performing a dust compressing operation and a dust brushing operation.

Another object of the present invention is to provide a dust collecting apparatus for a vacuum cleaner and a vacuum cleaner having the same, the dust collecting apparatus capable of collecting dust blocked above a first dust storage unit to the first dust storage unit.

Technical Solution

To achieve these and other advantages and in accordance with the purpose of the present invention, as embodied and broadly described herein, there is provided a dust collecting apparatus for a vacuum cleaner, comprising: a first cyclone installed in a first case, and configured to separate dust from air introduced together with foreign materials and to discharge the dust to a first dust storage unit; a second cyclone mounted above the first cyclone, and configured to separate fine dust from the air having dust separated therefrom by the first cyclone, and to discharge the fine dust to a second dust storage unit; a compression device configured to compress the dust stored in the first dust storage unit, by at least partially performing a clockwise rotation in one direction along an outer circumferential surface of a second case which accommodates therein the second dust storage unit, and by at least partially performing a counterclockwise rotation in an opposite direction to the clockwise rotation; a screw rotatably installed above the compression device, spirally extended along an outer circumference, and configured to guide collection of dust into the first dust storage unit; a driving unit configured to transmit a driving force to the compression device such that the clockwise rotation and the counterclockwise rotation of the compression device are selectively performed; and a gear unit installed between the compression device and the screw, and configured to clockwise-rotate the screw in a state that the compression device performs the clockwise rotation and the counterclockwise rotation.

In an embodiment of the present invention, the gear unit includes: a first gear installed on an outer circumference of the second case, and coupled to an upper side of the compression device so as to be rotatable together with the compression device; a second gear spaced apart from the first gear, and arranged on an inner circumference of the screw; and a link gear disposed between the first and second gears, and connected to the first and second gears so as to transmit a rotational force of the first gear to the second gear.

The link gear includes: first and second fixed gears installed to be spaced apart from each other, and arranged to be engaged with the second gear, respectively; a third fixed gear installed to be spaced apart from the first and second gears, and arranged to be engaged with the first fixed gear; and an orbiting gear arranged to be rotatable on at least part of an outer circumference of the first gear, in an engaged state with the first gear, so as to be selectively engaged with the second and third fixed gears, in order to selectively transmit a rotational force of the first gear to the second and third fixed gears.

A guide cut-out portion is formed on one surface of the screw in a circular arc shape, at a position spaced apart from the outer circumference of the first gear by a predetermined distance. And the guide cut-out portion guides a rotation shaft of the orbiting gear in order to enable an orbiting operation of the orbiting gear.

The first to third fixed gears are rotatably fixed to one surface of the screw.

The guide cut-out portion is formed on one surface of the screw provided among the first gear, the second fixed gear, and the third fixed gear.

In another embodiment of the present invention, a guide vane is upward inclined in the one direction on an outer circumference of the screw, so as to collect dust blocked on the outer circumference of the screw to the first dust storage unit, by the clockwise rotation of the screw.

The guide vane is provided in plurality. And the plurality of guide vanes are protruded in a diagonal direction from the outer circumference of the screw, and are spaced apart from each other with a predetermined interval therebetween along the outer circumference of the screw.

In another embodiment of the present invention, the apparatus further comprises a lower cover portion hinge-coupled to the first case to form bottom surfaces of the first and second dust storage units, and the lower cover portion rotated by the hinge such that the dust and the fine dust are simultaneously discharged, thereby simultaneously opening the first and second dust storage units.

The lower cover portion includes: a first cover hinge-coupled to the first case, and configured to open and close an outlet of the first dust storage unit; and a second cover connected to the first cover so as to open and close an outlet of the second dust storage unit, as the first cover is rotated by the hinge.

The compression device includes: a rotation gear rotatably connected to a motor which provides a driving force, and installed to the first cover so as to be exposed to outside of the dust collecting apparatus; a first rotation portion arranged at an opposite side to the rotation gear on the basis of the first cover, and connected to the rotation gear through the first cover so as to be rotated together with the rotation gear when the rotation gear is rotated; a second rotation portion installed at the outer circumference of the second case in a spaced state by a predetermined distance, and formed to be engaged with the first rotation portion when the outlet of the second dust storage unit is closed by the lower cover portion; and a dust compression rotation plate connected to the second rotation portion so as to be rotated together with the first and second rotation portions when the rotation gear is rotated, and configured to compress dust colleted at the first dust storage unit while reciprocating.

The apparatus further comprises a dust compression fixing plate fixed to a region between an inner circumferential surface of the first case and an outer circumferential surface of the second case, and configured to induce a reciprocating motion of the dust compression rotation plate and to restrict a movement of dust compressed by the dust compression rotation plate.

The first rotation portion is provided with a plurality of protrusions spirally formed from its center, and the second rotation portion is provided with accommodation portions for accommodating end parts of the protrusions, at a lower end thereof. And the first and second rotation portions are engaged with each other so as to be rotatable simultaneously, as the end parts of the protrusions are inserted into the accommodation portions.

To achieve these and other advantages and in accordance with the purpose of the present invention, as embodied and broadly described herein, there is also provided a vacuum cleaner, comprising: a cleaner body; a suction unit for sucking dust including foreign materials into the cleaner body by a suction force generated from the cleaner body; and a dust collecting apparatus for separating the foreign materials from the air sucked through the suction unit, and collecting the foreign materials, wherein the dust collecting apparatus includes: a first cyclone installed in a first case, and configured to separate dust from air introduced together with foreign materials and to discharge the dust to a first dust storage unit; a second cyclone mounted above the first cyclone, and configured to separate fine dust from the air having dust separated therefrom by the first cyclone, and to discharge the fine dust to a second dust storage unit; a compression device configured to compress the dust stored in the first dust storage unit, by at least partially performing a clockwise rotation in one direction along an outer circumferential surface of a second case which accommodates therein the second dust storage unit, and by at least partially performing a counterclockwise rotation in an opposite direction to the clockwise rotation; a screw rotatably installed above the compression device, spirally extended along an outer circumference, and configured to guide collection of dust into the first dust storage unit; a driving unit configured to transmit a driving force to the compression device such that the clockwise rotation and the counterclockwise rotation of the compression device are selectively performed; and a gear unit installed between the compression device and the screw, and configured to clockwise-rotate the screw in a state that the compression device performs the clockwise rotation and the counterclockwise rotation.

Advantageous Effects

The present invention provides the dust collecting apparatus capable of simultaneously operating the dust compression rotation plate and the screw by one power source, by including the screw having the guide vane, by including the gear unit having the fixed gears and the orbiting gear, etc.

The guide vane of the dust collecting apparatus is upward inclined in one direction, a clockwise rotation direction on the outer circumference of the screw, thereby enabling dust to be collected in the first dust storage unit even if foreign materials are blocked.

The dust collecting apparatus for a vacuum cleaner enables the screw to be clockwise rotated even when the dust compression rotation plate is rotated clockwise and counterclockwise. Accordingly, as dust blocked at the inlet of the first dust storage unit drops down, a dust collecting performance is enhanced.

The dust collecting apparatus for a vacuum cleaner enables operations of the dust compression rotation plate and the screw by one power source, and the dust compression rotation plate and the screw are driven to operate individually.

MODES FOR CARRYING OUT THE PREFERRED EMBODIMENTS

Figure 1:
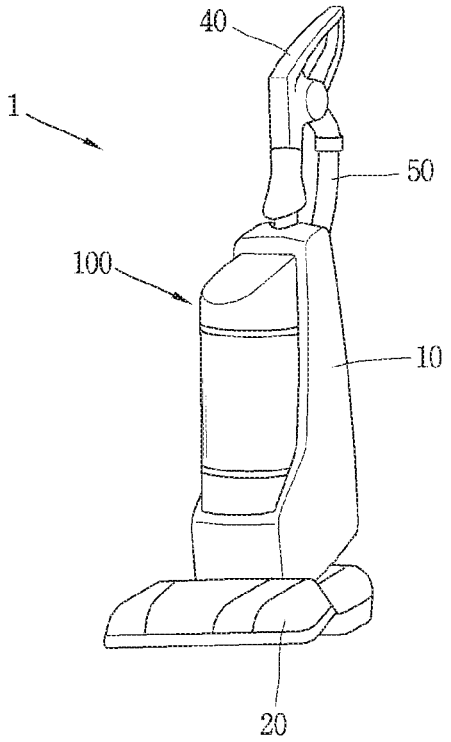
FIG. 1 is a perspective view of an upright type vacuum cleaner according to the present invention.

Hereinafter, a dust collecting apparatus and a vacuum cleaner having the same according to the present invention will be explained in more detail with reference to the attached drawings. In the drawings, the same or equivalent components may be provided with the same or similar reference numbers, and description thereof will not be repeated.

FIG. 1 is a perspective view of an upright type vacuum cleaner 1 according to the present invention. And FIG. 2 is a perspective view of the upright type vacuum cleaner 1 shown in FIG. 1, which is seen from another direction.

Figure 2:
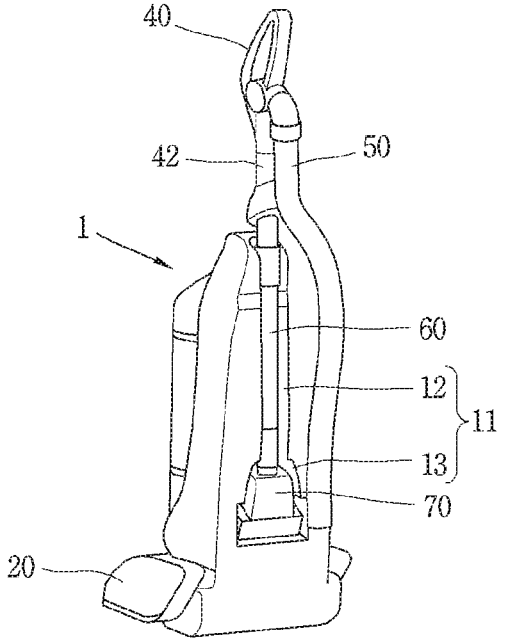
FIG. 2 is a perspective view of the upright type vacuum cleaner shown in FIG. 1, which is seen from another direction.

Referring to FIGS. 1 and 2, the upright type vacuum cleaner 1 includes a cleaner body 10 having a suction motor for generating a suction force, a suction unit 20 rotatably connected to a lower side of the cleaner body 10 and disposed on a floor surface, a dust collecting apparatus 100 mounted to the cleaner body 10 in a separable manner, auxiliary suction portions 60, 70 mounted to the cleaner body 10 in a separable manner and configured to clean a floor surface or a region rather than the floor surface, a handle 40 provided at an upper part of the cleaner body 10, and a connection hose 50 connected to the handle 40 and the cleaner body 10.

A suction opening for sucking dust on a floor surface and air is formed at a bottom surface of the suction unit 20, and an agitator for inducting dust or foreign materials to inside of the suction opening is rotatably mounted to the inside of the suction opening.

The dust collecting apparatus 100 may be detachably mounted to a front side of the body 10, and the auxiliary suction portions 60, 70 may be detachably mounted to a rear side of the body 10. A suction motor (not shown) is positioned at an inner lower side of the body, and the dust collecting apparatus 100 is mounted to the body above the suction motor. However, a position of the suction motor is not limited to the position.

Air sucked by a suction force generated by rotation of the suction motor passes through the dust collecting apparatus 100. In this process, fine dust and dust are separated from the air, and the fine dust and the dust are stored in the dust collecting apparatus 100.

The auxiliary suction portions 60, 70 include a nozzle 70 for cleaning a floor surface or a region rather than the floor surface, and a suction pipe 60 for connecting the nozzle 70 and the handle 40 to each other. A mounting portion 11 for mounting the auxiliary suctin portions 60, 70 is formed on a rear surface of the body 10. A suction pipe mounting portion 12 for mounting the suction pipe 60, and a nozzle mounting portion 13 for mounting the nozzle 70 are formed at the mounting portion 11. With such a configuration, a difficulty in separately storing the nozzle is solved.

A flow path (not shown), along which dust and air sucked through the nozzle 70 flow, is formed in the handle 40. The connection hose 50 makes dust and air sucked through the nozzle 70 move to the body 10. The connection hose 50 may have its length controllable, and may be formed of a flexible material. And a driving wheel is mounted to a lower side of a rear surface of the body 10.

Hereinafter, a dust collecting apparatus 200 which can be applied to the aforementioned upright type vacuum cleaner 1 will be explained.

An entire structure of the dust collecting apparatus 200 and a flow of air and foreign materials will be explained with reference to FIGS. 3 to 5, and a detailed structure of the present invention will be explained later with reference to FIGS. 6 to 11.

Figure 3:
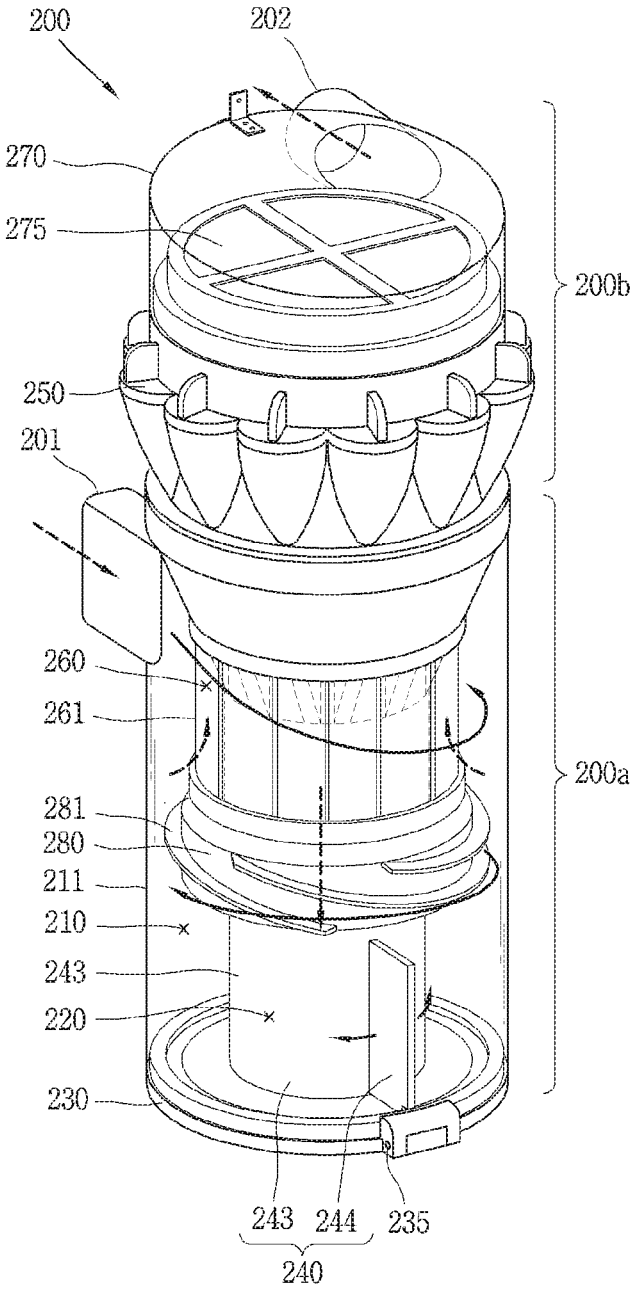
FIG. 3 is a perspective view of a dust collecting apparatus according to the present invention.

FIG. 3 is a perspective view of the dust collecting apparatus 200 according to an embodiment of the present invention. FIG. 4 is a sectional view showing an inner structure of the dust collecting apparatus 200 shown in FIG. 3. And FIG. 5 is a conceptual view of the inner structure of the dust collecting apparatus 200 shown in FIG. 4, which is seen from another direction.

Figure 4:
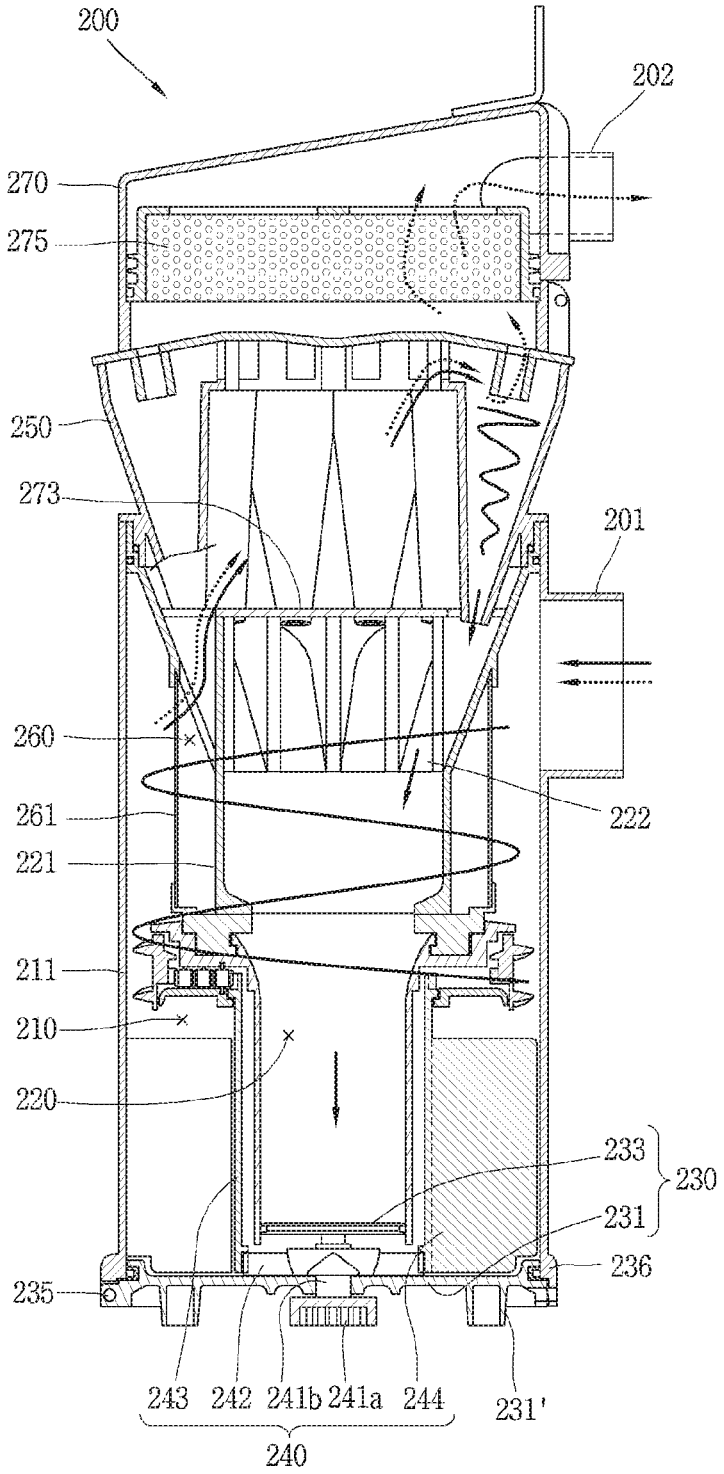
FIG. 4 is a sectional view showing an inner structure of the dust collecting apparatus shown in FIG. 3.
Figure 5:
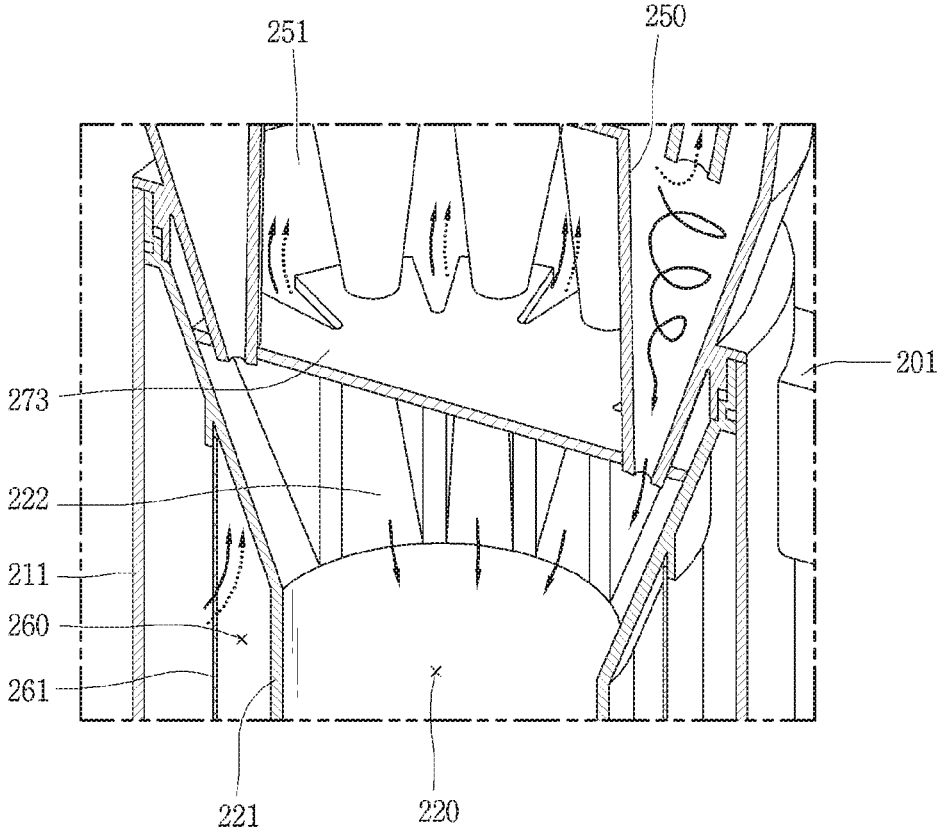
FIG. 5 is a conceptual view of the inner structure of the dust collecting apparatus shown in FIG. 4, which is seen from another direction.

Referring to FIGS. 3 to 5, the dust collecting apparatus 200 according to the present invention has a structure to collect dust and fine dust in a distinguished manner, and a structure to simultaneously discharge collected dust and fine dust. It is shown that the dust collecting apparatus 200 is applied to the upright type vacuum cleaner 1 of FIGS. 1 and 2. However, the structure of the dust collecting apparatus 200 is not necessarily limited to the upright type vacuum cleaner 1. That is, the dust collecting apparatus 200 may be also applicable to a canister type vacuum cleaner.

The dust collecting apparatus 200 includes a first cyclone, a second cyclone 250, a first dust storage unit 210, a second dust storage unit 220, a lower cover portion 230 and a compression device 240.

By a suction force generated from the suction motor of the vacuum cleaner, air and foreign materials are introduced to an inlet 201 of the dust collecting apparatus 200. The air introduced to the inlet 201 of the dust collecting apparatus 200 is filtered by the first cyclone and the second cyclone 250 sequentially, while flowing along a flow path. Then, the air is discharged to outside through an outlet 202. Dust and fine dust separated from the air are collected to the dust collecting apparatus 200.

A cyclone means a device for separating particles by a centrifugal force applied to a body by performing an orbiting motion. The cyclone is configured to separate foreign materials such as dust or fine dust, from air introduced into the cleaner body by a suction force. In this specification, dust having a relatively large particle size is defined as 'dust', dust having a relatively small particle size is defined as 'fine dust', and dust having a smaller particle size than the 'fine dust' is defined as 'ultrafine dust'.

In the dust collecting apparatus 200 of FIG. 3, the first cyclone is formed by a first case 211, a second case 221, and a mesh filter 261. The first cyclone primarily separates dust from air introduced into the dust collecting apparatus 200. Air and foreign materials introduced into the first case 211 through the inlet 201 of the dust collecting apparatus 200 are separated into air and dust by the first cyclone. Here, the air is introduced into the second cyclone 250, and the dust is collected at the first dust storage unit 210.

Dust having a relatively large weight flows downward gradually, while spirally performing an orbiting motion at a region between an inner circumferential surface of the first case 211 and the mesh filter 261, by a centrifugal force. A guide vane 281 for forming a spiral flow path so as to guide an orbiting movement of dust is formed at a lower part of the mesh filter 261. Dust separated from air is guided by the guide vane 281 installed at a lower end of the mesh filter 261, thereby being collected at the first dust storage unit 210.

As explained later, the guide vane 281 is upward extended in an arrow direction shown in FIGS. 3 and 6. Here, the arrow direction indicates a rotation direction of a screw 280. The guide vane 281 is upward inclined in the rotation direction of the screw 280, and is configured to drop dust downward by rotating the screw 280 when dust is blocked by the guide vane 281. A detailed structure of the guide vane 281 will be explained with reference to FIGS. 6 to 8.

A reference size for distinguishing dust and fine dust from each other may be determined by the mesh filter 261. A foreign material having a size small enough to pass through a hole of the mesh filter 261 may be defined as fine dust, whereas a foreign material having a size large enough not to pass through the hole of the mesh filter 261 may be defined as dust.

The dust collecting apparatus 200 may be divided into a first part 200*a* where the first cyclone is arranged, and a second part 200*b* where the second cyclone 250 is arranged. The inlet of the dust collecting apparatus 200 is formed at an upper region of the first part 200*a*, whereas the outlet 202 of the dust collecting apparatus 200 is formed at an upper region of the second part 200*b*.

Air and fine dust having a relatively smaller weight than dust move from the first part 200*a* to the second part 200*b*, along a connection passage 260 formed between the mesh filter 261 and an outer circumferential surface of the second case 221.

Referring to FIG. 4, an inner structure of the first part 200*a* and the second part 200*b* can be seen.

Air and fine dust, which have moved to the second part 200*b* along the connection passage 260, are distributed to the plurality of second cyclones 250 arranged at the periphery of the second part 200*b*. Like the first cyclone, the second cyclone 250 also separates fine dust from air by using a centrifugal force.

Air and fine dust spirally-perform an orbiting motion in the second cyclone 250.

Air having a relatively smaller weight is upward discharged by a suction force of the second cyclone 250. Then, the air is discharged out through the outlet 202 formed at an upper region of the second part 200*b*. A porous pre-filter 275 is installed at a flow path connected from the second cyclone 250 to the outlet 202. The pre-filter 275 filters ultrafine dust from air.

Fine dust having a relatively smaller size is discharged to a lower side of the second cyclone 250. The fine dust drops by a gravitational force, thereby being collected at the second dust storage unit 220. A discharge passage 252 connected to the second dust storage unit 220 is formed at a lower side of the second cyclone 250. The fine dust is guided to the second dust storage unit 220 from the second cyclone 250 along the discharge passage 252.

A partition wall 273 is formed at a boundary between the first part 200*a* and the second part 200*b*. The partition wall 273 is formed to generate a flow in one direction. The partition wall 273 may be arranged so as to be enclosed by the second cyclones 250. If the partition wall 273 is not provided, fine dust discharged to a lower side of the second cyclones 250 may flow to an inlet of the second cyclones 250.

Referring to FIG. 5, a housing 251 for fixing the second cyclones 250 may be formed around the plurality of second cyclones 250 arranged in a circular shape. The housing 251 may be integrally formed with the second cyclones 250. The second cyclone 250 may be formed to have a conical shape having its inner diameter decreased downward. With such a configuration, even if upper regions of the second cyclones 250 contact each other, lower regions thereof may be spaced apart from each other. And each space where air and fine dust flow is formed between the second cyclones 250 adjacent to each other.

The partition wall 273 does not cover the spaces formed among the second cyclones 250. The connection passage 260, which forms a flow path from the first part 200*a* to the second part 200*b*, is connected to the spaces formed among the second cyclones 250. Thus, air and fine dust may move from the first part 200*a* to the second part 200*b*, through the spaces formed among the second cyclones 250. Fine dust having moved to the second part 200*b* is distributed to the second cyclones 250 in a space surrounded by the second cyclones 250.

An inclination portion 222 may be slantly formed at a region connected to an outlet of a lower side of the second cyclones 250, in order to guide drop of fine dust. Fine dust drops to the second dust storage unit 220 along the inclination portion 222.

Referring to FIGS. 3 and 4 again, the first dust storage unit 210 is configured to collect dust primarily separated from air by the first cyclone. The first dust storage unit 210 is formed in a ring shape between an inner circumferential surface of the first case 211 and an outer circumferential surface of a second rotation portion 243. A bottom surface of the first dust storage unit 210 is formed by a second cover 233 of the lower cover portion 230, and dust is mainly accumulated on the second cover 233 of the lower cover portion 230.

The first case 211 and the second rotation portion 243 are components of the first dust storage unit 210. The first case 211 forms appearance of the dust collecting apparatus 200, and the second case 221 and the second rotation portion 243 are arranged in the first case 211. As shown in FIGS. 3 and 4, the first case 211, the second case 221 and the second rotation portion 243 may be formed in a cylindrical shape.

The second dust storage unit 220 is arranged to be enclosed by the first dust storage unit 210. As shown in FIG. 3, the second dust storage unit 220 may be arranged in the middle of the first dust storage unit 210. The second dust storage unit 220 is configured to collect fine dust secondarily separated from air by the second cyclones 250. Unlike the first dust storage unit 210 formed by the first case 211, the second case 221 and the lower cover portion 230, the second dust storage unit 220 is formed by the second case 221, and a first cover 231 of the lower cover portion 230.

The lower cover portion 230 is hinge-coupled to the first case 211, thereby forming bottom surfaces of the first dust storage unit 210 and the second dust storage unit 220. Since an outlet of the first dust storage unit 210 maintains a sealed state by the second cover 233, dust accumulated on the first dust storage unit 210 does not leak to the outside of the dust collecting apparatus 200. Further, since an outlet of the second dust storage unit 220 maintains a sealed state by the first cover 231, dust accumulated on the second dust storage unit 220 does not leak to the outside of the first dust storage unit 210 or the dust collecting apparatus 200.

If dust accumulated on the lower cover portion 230 is dispersed without being at a single region, the dust may be scattered or may be discharged to an unintended place. In order to solve such a problem, in the present invention, dust collected at the first dust storage unit 210 is compressed by a compression unit 240.

At least part of the compression unit 240 is rotatably connected to the lower cover portion 230. The compression device 240 reciprocates along an outer circumferential surface of the second case 221, so as to compress dust collected at the first dust storage unit 210. Dust collected at the first dust storage unit 210 is compressed by the compression device 240, and is collected at a partial region of the first dust storage unit 210. Accordingly, scattering of dust may be prevented in a dust discharging process, and a probability to discharge the dust to an undesired region may be significantly lowered.

Figure 6:
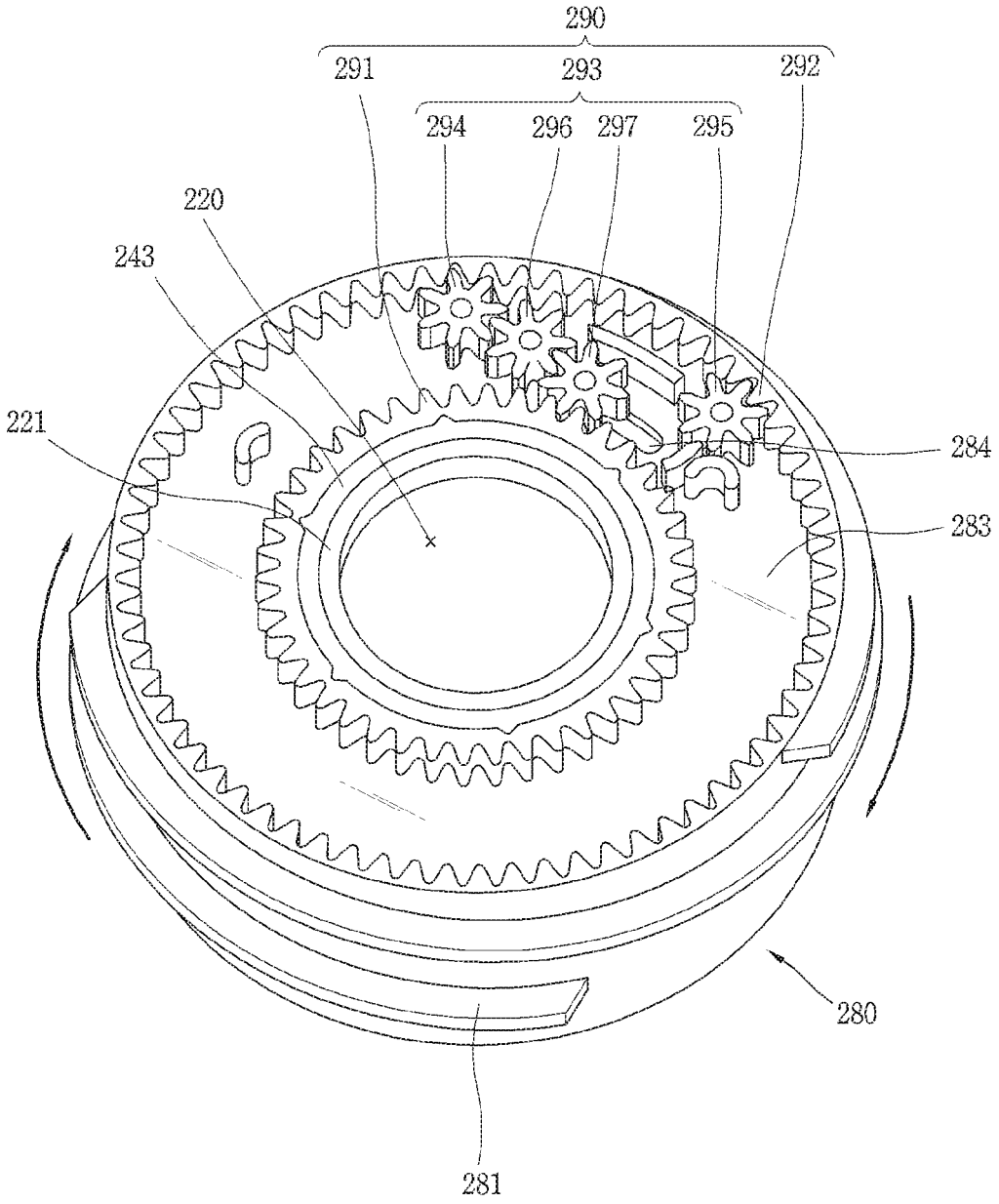
FIG. 6 is a perspective view showing an inner structure of a screw of FIG. 3.
Figure 7:
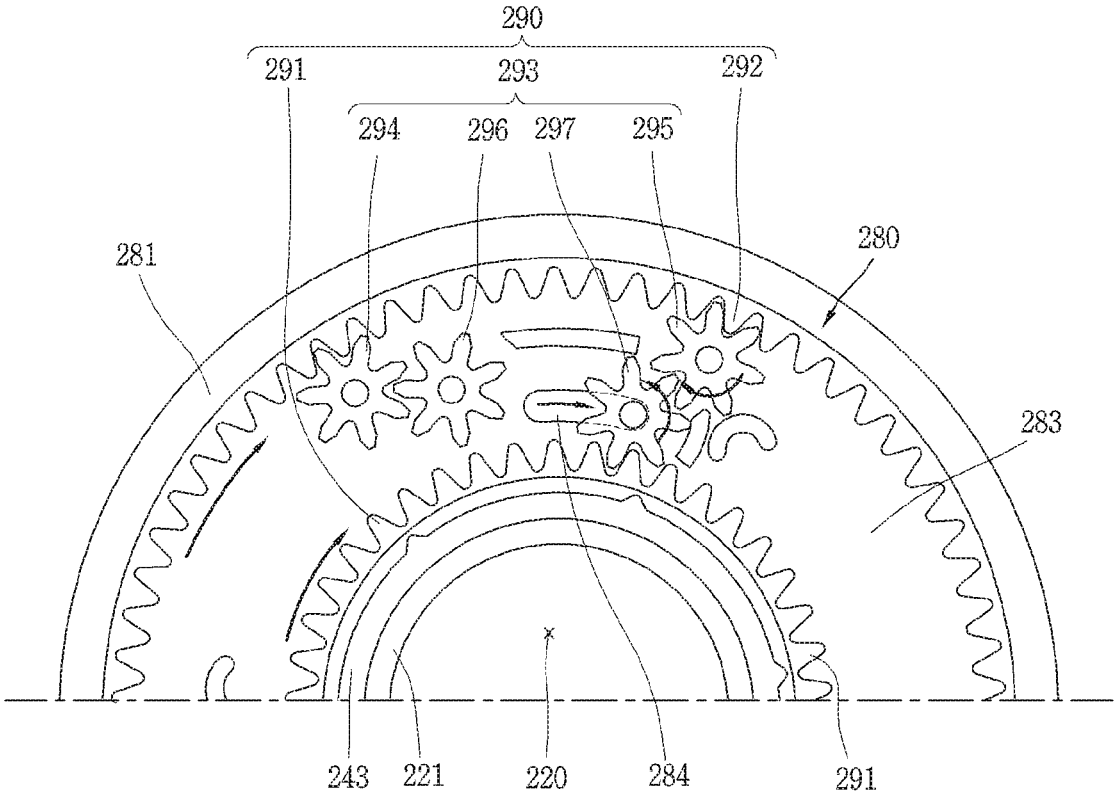
FIG. 7 is a conceptual view showing a clockwise rotation of a compression device shown in FIG. 6.

FIG. 6 is a perspective view showing an inner structure of a screw 280 of FIG. 3. FIG. 7 is a conceptual view showing a clockwise rotation of the compression device 240 shown in FIG. 6. And FIG. 8 is a conceptual view showing a counterclockwise rotation of the compression device 240 shown in FIG. 6.

Figure 8:
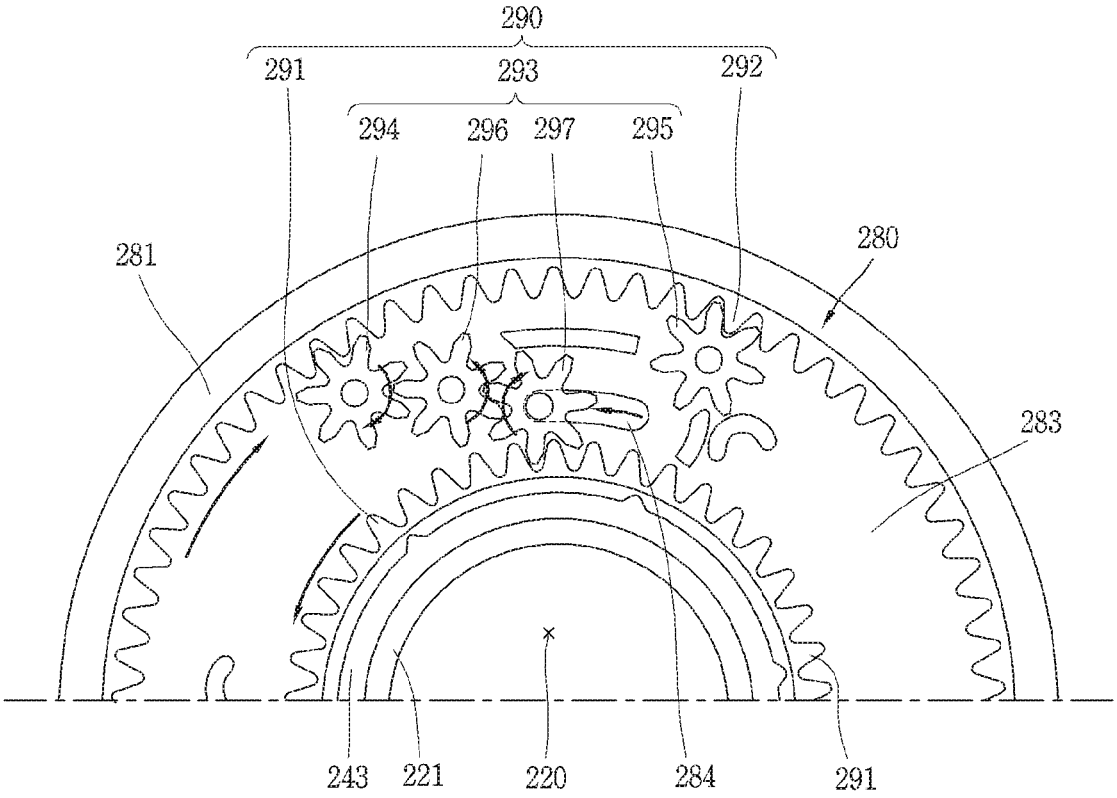
FIG. 8 is a conceptual view showing a counterclockwise rotation of the compression device shown in FIG. 6.

Referring to FIGS. 6 to 8, a structure and an operation of the screw 280, a gear unit 290, the compression device 240, etc. of the present invention will be explained.

The compression device 240 can perform a clockwise rotation and a counterclockwise rotation as at least part thereof is spaced apart from an outer circumference of the second case 221. As the compression device 240 is rotated by receiving a driving force from a driving unit 249, dust collected at the first dust storage unit 210 is compressed. The clockwise rotation may be a rotation in one direction. FIGS. 6 to 8 show that the screw 280 is rotated clockwise. Here, the clockwise rotation of the screw 280 will be referred to as a clockwise rotation, and a counterclockwise rotation of the screw 280 will be referred to as a counterclockwise rotation. However, the present invention is not limited to this.

The driving unit 249 selectively enables a clockwise rotation and a counterclockwise rotation by transmitting a driving force to the compression device 240. The driving unit 249 may include a motor, and may transmit a driving force to the compression device 240 by receiving a power from a power unit (not shown). A rotation gear 241*a* is connected to the driving unit 249. And a dust compression rotation plate 244 is rotated in a reciprocating manner, as the driving force is transmitted to the dust compression rotation plate 244 through the rotation gear 241*a*.

As explained later, the compression device 240 includes the dust compression rotation plate 244. And the dust compression rotation plate 244 is rotated by the driving force received from the driving unit 249. If the dust compression rotation plate 244 which is performing a clockwise rotation is restricted from moving to a direction of the clockwise rotation by compressed dust, the dust compression rotation plate 244 performs a counterclockwise rotation to compress dust disposed at another part of the first dust storage unit 210. Accordingly, the dust compression rotation plate 244 is continuously operated without being stopped.

The screw 280 is rotatably installed above the compression device 240. The screw 280 includes a guide vane 281 spirally extended along an outer circumference of the screw 280 and configured to collect dust at the first dust storage unit 210. The guide vane 281 is extended from the outer circumference of the screw 280 to an inner circumference of the first case 211, and may be upward inclined in one direction, a direction of the clockwise rotation.

The guide vane 281 may be provided in plurality, and the plurality of guide vanes 281 may be protruded from the outer circumference of the screw 280 in a diagonal direction. And the plurality of guide vanes 281 may be spaced apart from each other with a predetermined interval therebetween along the outer circumference of the screw 280. FIG. 3 shows that the plurality of guide vanes 281 are spaced apart from each other up and down, with a predetermined interval therebetween.

Dust separated from the first cyclone, etc. may be blocked by the guide vane 281. In this case, collection of other dust is hindered by the dust blocked by the guide vane 281. This may lower a dust collecting function to the first dust storage unit 210.

In order to solve such a problem, the dust compression rotation plate 244 performs a clockwise rotation or a counterclockwise rotation, and the screw 280 connected to the dust compression rotation plate 244 performs a clockwise rotation to drop separated dust blocked by the guide vanes 281.

Even if the dust compression rotation plate 244 performs a clockwise rotation or a counterclockwise rotation, the screw 280 can perform a clockwise rotation by the gear unit 290 to be explained later. This will be explained later.

As aforementioned, the guide vanes 281 are upward inclined in a clockwise rotation direction. If the screw 280 is rotated, dust blocked by the guide vanes 281 receives a centrifugal force. The dust is guided by an inclination of the guide vanes 281, and drops down by the centrifugal force.

The gear unit 290 is installed between the compression device 240 and the screw 280, and enables the screw 280 to perform a clockwise rotation in a state that the dust compression rotation plate 244 is rotated clockwise and counterclockwise.

The gear unit 290 may include a first gear 291 connected to the compression device 240, a second gear 292 arranged on an inner circumference of the screw 280, and a link gear 293 connected to the first and second gears 291, 292.

The first gear 291 is rotatably coupled to an upper side of the compression device 240. A second rotation portion 243 rotated by a driving force generated from the driving unit 249 is installed at the outer circumference of the second case 221, in a spaced manner from the second case 221 by a predetermined distance. As shown in FIG. 6, the first gear 291 is coupled to an upper side of an outer circumference of the second rotation portion 243. With such a configuration, the first gear 291 may be rotated together with the compression device 240.

The second gear 292 is coupled to the inner circumference of the screw 280 so as to be rotated clockwise by a driving force transferred through the first gear 291 and the link gear 293.

The link gear 293 is arranged between the first and second gears 291, 292, and is connected to the first and second gears 291, 292 so as to transmit a rotational force of the first gear 291 to the second gear 292. Further, the link gear 293 includes first to third fixed gears 294, 295, 296, and an orbiting gear 297.

The first and second fixed gears 294, 295 are arranged to be engaged with the second gear 292, and the first and second fixed gears 294, 295 are spaced apart from each other. The third fixed gear 296 may be arranged to be engaged with the first fixed gear 294, for instance. Rotation shafts of the first to third fixed gears 294, 295, 296 may be coupled to an inner bottom surface of the screw 280, or may be coupled to a surface protruded from a bottom surface 283 by a predetermined distance with consideration of an installation height of the first and second gears 291, 292.

The orbiting gear 297 is arranged to be rotatable on at least part of an outer circumference of the first gear 291, in an engaged state with the first gear 291. And the orbiting gear 297 is selectively engaged with the second and third fixed gears 295, 296. FIG. 8 shows that the orbiting gear 297 is engaged with the first gear 291 and the third fixed gear 296, by a counterclockwise rotation of the compression device 240. And FIG. 7 shows that the orbiting gear 297 is engaged with the first gear 291 and the second fixed gear 295, by a clockwise rotation of the compression device 240.

The orbiting gear 297 is installed on a guide cut-out portion 284 formed on one surface of the screw 280, so as to be rotatable. FIG. 6 shows an example of the guide cut-out portion 284 formed at a position spaced apart from the outer circumference of the first gear 291 by a predetermined distance, in a circular arc shape. Preferably, the guide cut-out portion 284, the first gear 291, and the second case 221 are concentrically arranged.

With such a configuration, a rotational force of the first gear 291 is selectively transmitted to the second and third fixed gears 295, 296. The rotational force transmitted to the second fixed gear 295 is transmitted to the second gear 292. And the rotational force transmitted to the third fixed gear 296 is transmitted to the first fixed gear 294, and then is transmitted to the second gear 292. The screw 280 can perform a clockwise rotation by the rotational force transmitted through the first fixed gear 294 or the second fixed gear 295.

Hereinafter, will be explained an operation to transmit a driving force to the screw 280 from the driving unit 249 through the gear unit 290.

Referring to FIG. 7, the dust compression rotation plate 244 is rotated clockwise by a driving force transferred from the driving unit 249, and the first gear 291 connected to the dust compression rotation plate 244 is rotated together. As the first gear 291 is rotated clockwise, the orbiting gear 297 is rotated counterclockwise in an engaged state with the first gear 291. And the orbiting gear 297 is engaged with the second fixed gear 295 by performing a clockwise orbiting operation at the guide cut-out portion 284. The second fixed gear 295 is rotated clockwise in an engaged state with the orbiting gear 297 which is being rotated counterclockwise. Accordingly, the second gear 292 is rotated clockwise in an engaged state with the second fixed gear 295.

Referring to FIG. 8, the dust compression rotation plate 244 is rotated counterclockwise by a driving force transferred from the driving unit 249, and the first gear 291 connected to the dust compression rotation plate 244 is rotated together. As the first gear 291 is rotated counterclockwise, the orbiting gear 297 is rotated clockwise in an engaged state with the first gear 291. And the orbiting gear 297 is engaged with the third fixed gear 296 by performing a counterclockwise orbiting operation at the guide cut-out portion 284. The third fixed gear 296 is rotated counterclockwise in an engaged state with the orbiting gear 297 which is being rotated clockwise, and the first fixed gear 294 engaged with the third fixed gear 296 is rotated clockwise. Accordingly, the second gear 292 is rotated clockwise in an engaged state with the first fixed gear 294.

Figure 9:
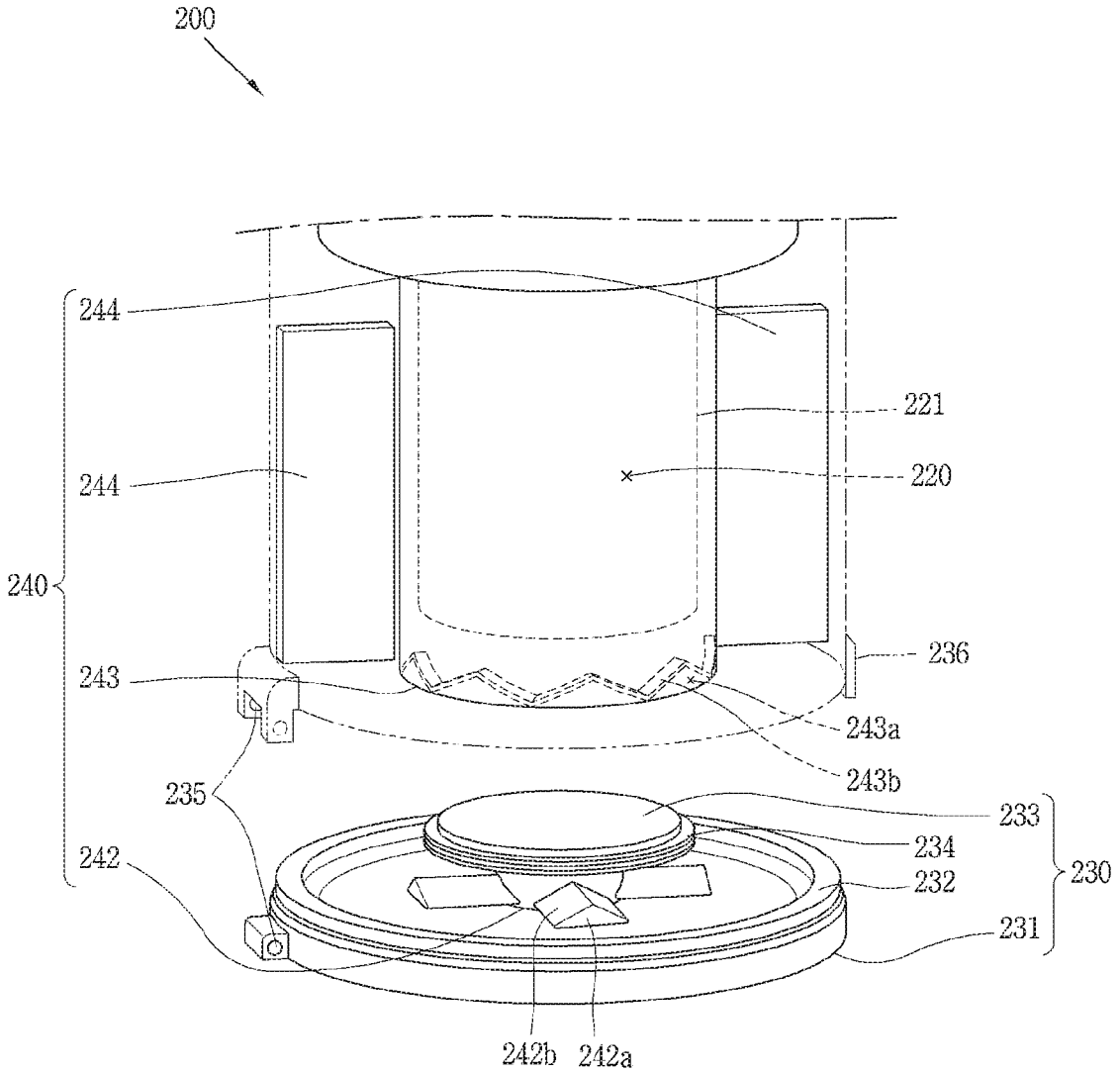
FIG. 9 is a disassembled perspective view of a lower cover portion shown in FIG. 3.
Figure 10:
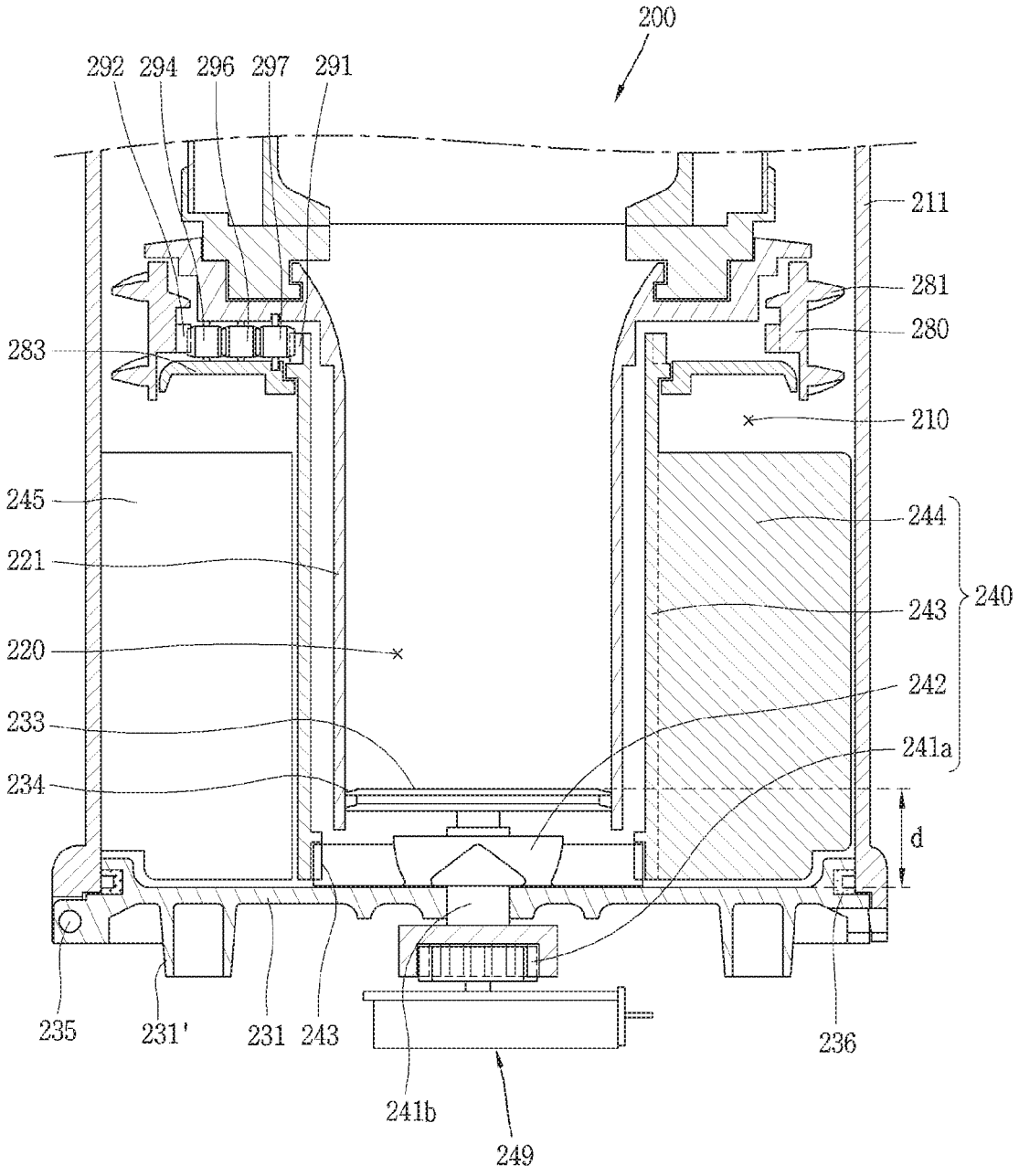
FIG. 10 is a sectional view showing an inner structure of a lower side of a first part shown in FIG. 3.

FIG. 9 is a disassembled perspective view of the lower cover portion 230 shown in FIG. 3. FIG. 10 is a sectional view showing an inner structure of a lower side of the first part 200*a* shown in FIG. 3. And FIG. 11 is a conceptual view showing an open state of the lower cover portion 230 shown in FIG. 10.

Figure 11:
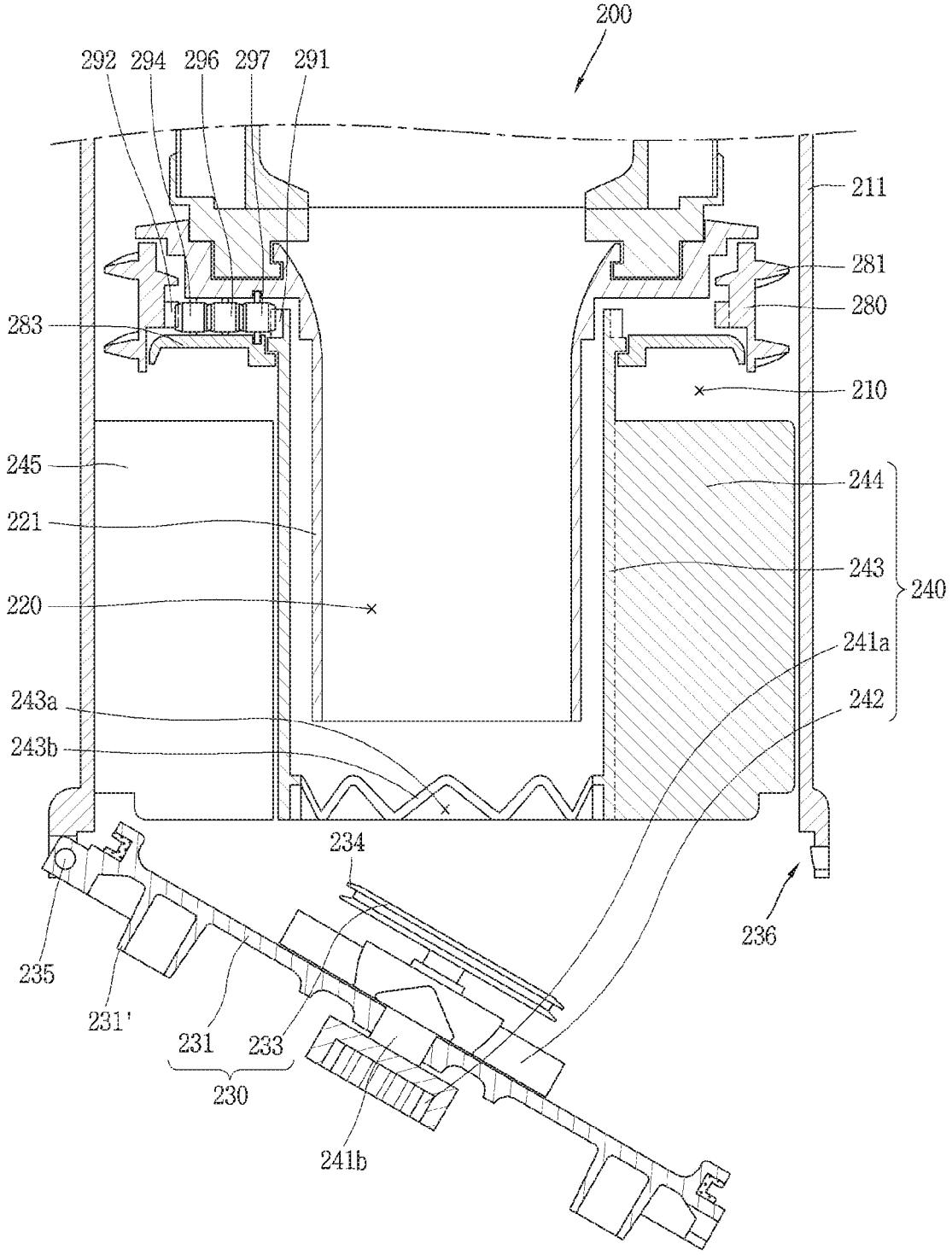
FIG. 11 is a conceptual view showing an open state of the lower cover portion shown in FIG. 10.

Referring to FIGS. 9 to 11, a lower side of the first part 200*a* of the dust collecting apparatus will be explained.

Referring to FIGS. 9 to 11, the outlet of the first dust storage unit 210 and the outlet of the second dust storage unit 220 may be formed to be open in directions parallel to each other. The lower cover portion 230 is rotated by a hinge 235 such that dust and fine dust are simultaneously discharged, thereby simultaneously opening the first dust storage unit 210 and the second dust storage unit 220.

The lower cover portion 230 includes a first cover 231 and a second cover 233.

The first cover 231 is coupled to the first case 211 by the hinge 235. The first cover 231 is formed to open and close the outlet of the first dust storage unit 210. The first cover 231 is provided with a first sealing member 232 on its outer circumferential surface so as to close the outlet of the first dust storage unit 210. The first sealing member 232 is formed in a ring shape so as to correspond to an inner circumferential surface of the first case 211. Once the first cover 231 is coupled to the first case 211, at least part of the first sealing member 232 is inserted into the first dust storage unit 210, and is elastically transformed by being compressed by the inner circumferential surface of the first case 211. By the first sealing member 232, the first cover 231 may close the outlet of the first dust storage unit 210.

The second cover 233 is connected to the first cover 231 so as to open and close the outlet of the second dust storage unit 220, as the first cover 231 is rotated by the hinge 235. When the first cover 231 is rotated by the hinge 235, the second cover 233 is rotated together with the first cover 231, because the second cover 233 is connected to the first cover 231. Thus, the lower cover portion 230 may simultaneously open the first dust storage unit 210 and the second dust storage unit 220.

The second cover 233 is provided with a second sealing member 234 on its outer circumferential surface so as to close the outlet of the second dust storage unit 220. The second sealing member 234 is formed in a ring shape so as to correspond to an inner circumferential surface of the second case 221. Once the first cover 231 closes the first case 211, at least part of the second sealing member 234 is inserted into the second dust storage unit 220, and is elastically transformed by being compressed by the inner circumferential surface of the second case 221. By the second sealing member 234, the second cover 233 may close the outlet of the second dust storage unit 220.

The dust collecting apparatus 200 includes a coupling portion 236 for preventing separation of the first cover 231 from the first case 211 before a coupled state of the first case 211 is released by an external force. The coupling portion 236 couples the first case 211 and the first cover 231 to each other at an opposite side to the hinge 235.

The coupling portion 236 may be implemented as a button type hook, for instance. Once the first cover 231 is rotated around the hinge 235 so as to be adhered to the first case 211, the hook may couple the first case 211 and the first cover 231 with each other by being caught at the first cover 231. If a user presses the button, the coupled state of the hook may be released, and the first cover 231 may be rotated around the hinge 235 to simultaneously open the first dust storage unit 210 and the second dust storage unit 220.

If a user wishes to discharge dust and fine dust from the dust collecting apparatus 200, the user should release a coupled state by the coupling portion 236. As the coupled state by the coupling portion 236 is released, the lower cover portion 230 is rotated around the hinge 235 by gravity. Accordingly, the user may easily discharge dust collected at the first dust storage unit 210, and fine dust collected at the second dust storage unit 220, simultaneously. This may solve user inconvenience in discharging dust and fine dust two times.

Especially, the present invention includes the compression device 240 for compressing dust collected at the first dust storage unit 210. Dust collected at the first dust storage unit 210 is compressed by the compression device 240 at a partial region of the first dust storage unit 210. Accordingly, user convenience in easily discharging compressed dust and fine dust simultaneously may be provided by the compression device 240 and the lower cover portion 230 of the present invention.

A detailed structure of the compression device 240 and the lower cover portion 230 will be explained with reference to FIGS. 9 to 11.

Referring to FIGS. 9 to 11, the compression device 240 includes a rotation gear 241*a*, a first rotation portion 242, a second rotation portion 243, and the dust compression rotation plate 244.

The rotation gear 241*a* is coupled to the first cover 231 so as to be exposed to the outside of the dust collecting apparatus 200. The rotation gear 241*a* is shown in FIGS. 10 and 11. Once the dust collecting apparatus 200 is coupled to the cleaner body, the rotation gear 241*a* transmits a driving force of the driving unit 249 to the first and second rotation portions 242, 243, so as to rotate the dust compression rotation plate 244.

As aforementioned in FIG. 1, the dust collecting apparatus 200 may be mounted to the cleaner body, or may be separated from the cleaner body. Referring to FIG. 10, a guide portion 231' for guiding coupling of the dust collecting apparatus 200 to a predetermined position of the cleaner body may be formed at the first cover 231. The guide portion 231' is formed to be protruded from the first cover 231. A space for accommodating the dust collecting apparatus 200 may be formed at the cleaner body, and a groove corresponding to the guide portion 231' may be formed at the space for accommodating the dust collecting apparatus 200. Once the dust collecting apparatus 200 is coupled to the cleaner body, the dust collecting apparatus 200 may be guided by the guide portion 231' and the groove to thus be mounted to a predetermined position. Once the dust collecting apparatus 200 is mounted to the cleaner body, the rotation gear 241*a* is engaged with a gear of the cleaner body.

The rotation gear 241*a* receives a driving force from the driving unit 249 connected to the cleaner body. The driving unit 249 of the cleaner body includes a motor, for instance. If a repulsive force is applied in an opposite direction to a rotation direction of the motor, the motor may change its rotation direction into the opposite direction. The motor of the driving unit 249 is distinguished from a suction motor for sucking dust-included air from the outside.

FIG. 10 illustrates an example to directly transmit a driving force to the rotation gear 241*a* by the driving unit 249. However, a connection relation between the driving unit 249 and the rotation gear 241*a* is not limited to this. That is, the driving unit 249 may transmit a driving force to the rotation gear 241*a* through another gear or a power transmission device.

The first rotation portion 242 is arranged at an opposite side to the rotation gear 241*a*, on the basis of the first cover 231. Thus, when the first cover 231 is coupled to the first case 211 by the coupling portion 236, the rotation gear 241*a* is exposed to the outside of the dust collecting apparatus. On the other hand, the first rotation portion 242 is arranged in the dust collecting apparatus 200.

The first rotation portion 242 is connected to the rotation gear 241*a* through the first cover 231, so as to be rotated together with the rotation gear 241*a* when the rotation gear 241*a* is rotated. For this, a rotation shaft 241*b* is provided. The rotation shaft 241*b* coaxially rotates the first and second rotation portions 242, 243.

The second rotation portion 243 is installed at an outer circumference of the second case 221 in a spaced manner. For instance, as shown in FIG. 9, an end part of the second case 221 may be formed in a ring shape. And the second rotation portion 243 may be entirely formed in a cylindrical shape to be installed at the outer circumference of the second case 221 in a spaced manner. The second case 221 may be fixed, and the second rotation portion 243 may perform a relative rotation on the outer circumference of the second case 221.

The first rotation portion 242 is provided with a plurality of protrusions 242*a* radially formed from its rotation center. The second rotation portion 243 is provided with accommodation portions 243*a* for accommodating end parts of the protrusions 242*a*, at a lower end thereof. In a coupled state of the first cover 231 to the first case 211 by the coupling portion 236, the end parts of the plurality of protrusions 242*a* are inserted into the accommodation portions 243*a*. Accordingly, the first and second rotation portions 242, 243 are engaged with each other so as to be rotatable simultaneously.

The protrusion 242*a* and the accommodation portion 243*a* are provided with inclination surfaces 242*b*, 243*b*, respectively, so as to be engaged with each other by being slid by inclination, even at a non-engagement position. When the lower cover portion 230 closes the outlet of the first dust storage unit 210 and the outlet of the second dust storage unit 220, the first rotation portion 242 and the second rotation portion 243 are engaged with each other. In this process, each protrusion 242*a* may be inserted into each accommodation portion 243*a* at a non-engagement position with each accommodation portion 243*a*. Nevertheless, since the protrusion 242*a* and the accommodation portion 243*a* are provided with the inclination surfaces 242*b*, 243*b*, respectively, the first and second rotation portions 242, 243 may move relatively to each other by being slid by the inclination surfaces 242*b*, 243*b*, and may be engaged with each other.

Referring to FIG. 10, the second case 221 is spaced apart from the first cover 231. The second cover 233 forms a stair-stepped portion (d) with the first cover 231 so as to be coupled to the second case 221. The first rotation portion 242 is arranged so as to be rotated at a space formed between the second case 221 and the first cover 231. And the second rotation portion 243 is arranged so as to be rotated at a space formed between the first case 211 and the second case 221. And the second cover 233 is installed on a rotation center shaft 242' of the first rotation portion 242, so as to be insertable into the second dust storage unit 220. The reason why the second cover 233 forms the stair-stepped portion (d) with the first cover 231 is for insertion into the second dust storage unit 220.

If the second cover 233 is rotated along the first rotation portion 242, dust collected in the second dust storage unit 220 may leak to the outside of the first dust storage unit 210 or the dust collecting apparatus 200. For prevention of this, the second cover 233 is connected to the first rotation portion 242 so as to be relatively rotatable. And the second sealing member 234 restricts rotation of the second cover 233 by a frictional force formed at the time of contacting an inner circumferential surface of the second case 221 when the first rotation portion 242 is rotated, in order to close the outlet of the second dust storage unit 220. Accordingly, even if the first rotation portion 242 is rotated, the second cover 233 may be scarcely rotated by the second sealing member 234. With such a configuration, leakage of fine dust collected in the second dust storage unit 220 may be prevented.

The dust compression rotation plate 244 is rotated together with the first and second rotation portions 242, 243 when the rotation gear 241*a* is rotated. FIGS. 4 to 9 show an example that the dust compression rotation plate 244 is extended from the first dust storage unit 210 on an outer circumference of the second rotation portion 243. The dust compression rotation plate 244 may be formed to be rotated together with the second rotation portion 243 by receiving a driving force from the first rotation portion 242. The dust compression rotation plate 244 compresses dust collected at the first dust storage unit 210 while reciprocating.

If a repulsive force is applied in an opposite direction to a rotation direction of the aforementioned driving unit (motor) of the cleaner body, the motor may change its rotation direction into the opposite direction. The dust compression rotation plate 244 receives a driving force through the gear of the cleaner body, the rotation gear 241*a*, and the first and second rotation portions 242, 243. Thus, if the rotation direction of the driving unit 249 is converted into the opposite direction, a rotation direction of the dust compression rotation plate 244 may be also converted into an opposite direction.

The dust collecting apparatus 200 further includes a dust compression fixing plate 245.

The dust compression fixing plate 245 may be fixed to the first and second cases 211, 212, or the lower cover portion 230, at a region between an inner circumferential surface of the first case 211 and an outer circumferential surface of the second case 221. The dust compression fixing plate 245 may be formed to have the same shape as the dust compression rotation plate 244.

The dust compression fixing plate 245 induces a reciprocating motion of the dust compression rotation plate 244. If the dust compression rotation plate 244 becomes closer to the dust compression fixing plate 245 while being rotated along the outer circumferential surface of the second case 221, a repulsive force occurs. As a result, the driving unit 249 inside the cleaner body is rotated in an opposite direction to its rotation direction. The gear of the cleaner body, the rotation gear 241*a*, and the first and second rotation portions 242, 243 sequentially connected to the driving unit 249 are also rotated in an opposite direction to their rotation direction. And the dust compression rotation plate 244 connected to the second rotation portion 243 is also rotated in an opposite direction to its rotation direction.

Thus, the dust compression rotation plate 244 performs a reciprocating motion for rotation from one side to another side and then rotation from said another side to said one side, repetitively, on the basis of the dust compression fixing plate 245. And dust collected in the first dust storage unit 210 is compressed at both sides of the dust compression fixing plate 245, by the reciprocating motion of the dust compression rotation plate 244.

The dust compression fixing plate 245 restricts a movement of the compressed dust. Since the dust compression fixing plate 245 is fixed unlike the dust compression rotation plate 244, dust compressed at both sides of the dust compression fixing plate 245 is restricted from moving by the dust compression fixing plate 245. Accordingly, even if the dust compression rotation plate 244 continuously performs a reciprocating motion in the first dust storage unit 210, the dust compression fixing plate 245 may prevent scattering of compressed dust.

FIG. 11 is a sectional view showing the dust collecting apparatus 200 where the lower cover portion 230 is in an open state.

While the vacuum cleaner is operated, the compression device 240 continuously compresses dust collected in the first dust storage unit 210. Accordingly, when the operation of the vacuum cleaner is completed, dust exists in a compressed state on both side surfaces of the dust compression fixing plate 245.

If a user releases a coupling state of the coupling portion 236 in order to discharge dust and fine dust collected in the dust collecting apparatus 200, the lower cover portion 230 is rotated around the hinge 235 as shown in FIG. 11. And the first and second dust storage units 210, 220 are open.

Referring to FIG. 11, if the first and second dust storage units 210, 220 are open, the first and second rotation portions 242, 243 engaged with each other become far from each other. The first rotation portion 242 moves along the lower cover portion 230, because it is coupled to the lower cover portion 230. The second rotation portion 243 maintains its arranged state on the outer circumferential surface of the second case 221.

The lower cover portion 230 forms bottom surfaces of the first and second dust storage units 210, 220, and simultaneously opens the first and second dust storage units 210, 220. Accordingly, in the present invention, dust collected at the first dust storage unit 210, and fine dust collected at the second dust storage unit 220 may be simultaneously discharged. Further, since dust is in a compressed state by the compression device 240, the dust may be prevented from scattering, and may be easily discharged by gravity.

In the present invention, dust is compressed by the compression device 240, and dust and fine dust are simultaneously discharged by using the lower cover portion 230. This may maximize convenience in discharging dust.

The aforementioned dust collecting apparatus for a vacuum cleaner, and the vacuum cleaner having the same are not limited to the aforementioned configuration and method. That is, the preferred embodiments may be selectively combined with each other partially or wholly for various modifications.

INDUSTRIAL APPLICABILITY

The present invention may be utilizable to industrial fields related to a dust collecting apparatus for a vacuum cleaner, and a vacuum cleaner.

The invention claimed is:

1. A dust collecting apparatus for a vacuum cleaner, comprising:

a first cyclone installed in a first case, and configured to separate dust from air introduced together with foreign materials and to discharge the dust to a first dust storage unit;

a second cyclone mounted above the first cyclone, and configured to separate fine dust from the air having dust separated therefrom by the first cyclone, and to discharge the fine dust to a second dust storage unit;

a compression assembly having at least a compression plate configured to compress the dust stored in the first dust storage unit, by at least partially performing a clockwise rotation in one direction along an outer circumferential surface of a second case which accommodates therein the second dust storage unit, and by at least partially performing a counterclockwise rotation in an opposite direction to the clockwise rotation;

a screw rotatably installed above the compression assembly, spirally extended along an outer circumference, and configured to guide collection of dust into the first dust storage unit;

a motor configured to transmit a driving force to the compression assembly such that the clockwise rotation and the counterclockwise rotation of the compression assembly are selectively performed; and a gear unit installed between the compression assembly and the screw to transmit a rotational force of the compression assembly to the screw, and configured to rotate the screw only in a clockwise direction irrespective of a rotational direction of the compression assembly, wherein an outer circumference of the second case and an inner circumference of the screw are arranged to face each other at a spaced position, and the gear unit includes:

a first gear provided on the outer circumference of the second case and coupled to an upper side of the compression assembly so as to be rotatable together with the compression assembly;

a second gear spaced apart from the first gear and arranged on the inner circumference of the screw; and a link gear provided between the first and second gears and connected to the first and second gears so as to transmit a rotational force of the first gear to the second gear.

2. The apparatus of claim 1, wherein the link gear includes:

a first fixed gear arranged to be engaged with the second gear;

a second fixed gear arranged to be engaged with the second gear at a position spaced apart from the first fixed gear;

a third fixed gear installed to be spaced apart from the first and second gears, and arranged to be engaged with the first fixed gear; and an orbiting gear configured to move to be selectively engaged with one of the second fixed gear and the third fixed gear in an engaged state with the first gear, in order to selectively transmit a rotational force of the first gear to one of the second fixed gear and the third fixed gear.

3. The apparatus of claim 2, wherein a guide cut-out portion is formed on one surface of the screw in a circular arc shape, at a position spaced apart from the outer circumference of the first gear by a predetermined distance, and wherein a rotational shaft of the orbiting gear is guided by the guide cut-out portion and moves between the second fixed gear and the third fixed gear along the circular arc shape of the guide cut-out portion.

4. The apparatus of claim 3, wherein the first to third fixed gears are rotatably fixed to one surface of the screw.

5. The apparatus of claim 3, wherein the guide cut-out portion is formed on one surface of the screw provided among the first gear, the second fixed gear and the third fixed gear.

6. The apparatus of claim 1, wherein a guide vane is upward inclined in the one direction on an outer circumference of the screw, so as to collect dust blocked on the outer circumference of the screw to the first dust storage unit, by the clockwise rotation of the screw.

7. The apparatus of claim 6, wherein the guide vane is provided in plurality, and wherein the plurality of guide vanes are protruded in a diagonal direction from the outer circumference of the screw, and are spaced apart from each other with a predetermined interval therebetween along the outer circumference of the screw.

8. The apparatus of claim 1, further comprising a lower cover portion hinge-coupled to the first case to form bottom surfaces of the first and second dust storage units, and the lower cover portion rotated by the hinge such that the dust and the fine dust are simultaneously discharged, thereby simultaneously opening the first and second dust storage units.

9. The apparatus of claim 8, wherein the lower cover portion includes:

a first cover hinge-coupled to the first case, and configured to open and close an outlet of the first dust storage unit; and a second cover connected to the first cover so as to open and close an outlet of the second dust storage unit, as the first cover is rotated by the hinge.

10. The apparatus of claim 9, wherein the compression assembly includes:

a rotation gear rotatably connected to the motor which provides the driving force, and installed to the first cover so as to be exposed to outside of the dust collecting apparatus;

a first rotation portion arranged at an opposite side to the rotation gear on the basis of the first cover, and connected to the rotation gear through the first cover so as to be rotated together with the rotation gear when the rotation gear is rotated; and a second rotation portion installed at the outer circumference of the second case in a spaced state by a predetermined distance, and formed to be engaged with the first rotation portion when the outlet of the second dust storage unit is closed by the lower cover portion, wherein the compression plate is a dust compression rotation plate connected to the second rotation portion so as to be rotated together with the first and second rotation portions when the rotation gear is rotated, and configured to compress dust collected at the first dust storage unit while reciprocating.

11. The apparatus of claim 10, further comprising a dust compression fixing plate fixed to a region between an inner circumferential surface of the first case and an outer circumferential surface of the second case, and configured to induce a reciprocating motion of the dust compression rotation plate and to restrict a movement of dust compressed by the dust compression rotation plate.

12. The apparatus of claim 10, wherein the first rotation portion is provided with a plurality of protrusions spirally formed from its center;

wherein the second rotation portion is provided with accommodation portions for accommodating end parts of the protrusions, at a lower end thereof; and wherein the first and second rotation portions are engaged with each other so as to be rotatable simultaneously, as the end parts of the protrusions are inserted into the accommodation portions.

13. The apparatus of claim 2, wherein the orbiting gear is configured to move to a position where the orbiting gear engages with the second fixed gear when the compression assembly rotates in the clockwise direction, and the orbiting gear is configured to move to a position where the orbiting gear engages with the third fixed gear when the compression assembly rotates in the counterclockwise direction.

14. The apparatus of claim 13, wherein when the compression assembly rotates in the clockwise direction, the screw is configured to rotate in the clockwise direction by the driving force sequentially transmitted through the first gear, the orbiting gear, the second fixed gear, and the second gear, and when the compression assembly rotates in a counterclockwise direction, the screw is configured to rotate in the clockwise direction by the driving force sequentially transmitted through the first gear, the orbiting gear, the third fixed gear, the first fixed gear, and the second gear.

15. The apparatus of claim 2, wherein one of the first fixed gear and the second fixed gear is rotated in the same direction as the second gear.

16. A dust collecting apparatus for a vacuum cleaner, comprising:

a first cyclone installed in a first case, and configured to separate dust from air introduced together with foreign materials and to discharge the dust to a first dust storage unit;

a second cyclone mounted above the first cyclone, and configured to separate fine dust from the air having dust separated therefrom by the first cyclone, and to discharge the fine dust to a second dust storage unit;

a compression plate configured to compress the dust stored in the first dust storage unit by at least partially performing a rotation in a first rotational direction along an outer circumferential surface of a second case which accommodates therein the second dust storage unit, and by at least partially performing a rotation in a second rotational direction opposite to the first rotational direction;

a screw rotatably installed above the compression plate, spirally extended along an outer circumference, and configured to guide collection of dust into the first dust storage unit;

a motor configured to transmit a driving force to the compression plate such that the rotation in the first rotational direction and the rotation in the second rotational direction of the compression plate are selectively performed; and a plurality of gears installed between the compression plate and the screw to transmit a rotational force of the compression plate to the screw, and configured to rotate the screw only in the first rotational direction irrespective of a rotational direction of the compression plate; wherein the screw includes a guide vane provided on an outer circumference of the screw and inclined upward in the first rotational direction such that the guide vane collects dust blocked on the outer circumference of the screw to the first dust storage unit by the rotation of the screw in the first rotational direction.

17. A dust collecting apparatus for a vacuum cleaner, comprising:

a first cyclone installed in a first case, and configured to separate dust from air introduced together with foreign materials and to discharge the dust to a first dust storage unit;

a second cyclone mounted above the first cyclone, and configured to separate fine dust from the air having dust separated therefrom by the first cyclone, and to discharge the fine dust to a second dust storage unit;

a compression plate configured to compress the dust stored in the first dust storage unit by at least partially performing a rotation in a first rotational direction along an outer circumferential surface of a second case which accommodates therein the second dust storage unit, and by at least partially performing a rotation in a second rotational direction opposite to the first rotational direction;

a screw rotatably installed above the compression plate, spirally extended along an outer circumference, and configured to guide collection of dust into the first dust storage unit;

a motor configured to transmit a driving force to the compression plate such that the rotation of the compression plate in the first rotational direction and the rotation of the compression plate in the second rotational direction are selectively performed;

a plurality of gears installed between the compression plate and the screw to transmit a rotational force of the compression plate to the screw, and configured to rotate the screw only in the first rotational direction irrespective of a rotational direction of the compression plate; and a lower cover portion hinge-coupled to the first case to form bottom surfaces of the first and second dust storage units, the lower cover portion being configured to rotate by the hinge such that the dust and the fine dust are simultaneously discharged, thereby simultaneously opening the first and second dust storage units.

* * * * *